US005431572A

United States Patent [19]

Surrey et al.

[11] Patent Number: 5,431,572

[45] Date of Patent: Jul. 11, 1995

[54] LOCK FOR PREVENTING UNAUTHORIZED USE OF ELECTRICAL APPLIANCES

[76] Inventors: Steve Surrey, 4809 Bella Pcaifica Row #203, San Diego, Calif. 92109; Michael J. Flynn, Jr., P.O. Box 1668, Rancho Santa Fe, Calif. 92067

[21] Appl. No.: 156,736

[22] Filed: Nov. 24, 1993

[51] Int. Cl.[6] ..... H01R 13/44

[52] U.S. Cl. ..... 439/134; 220/346

[58] Field of Search ..... 439/133, 134; 220/3.8, 220/345, 346, 349

[56] References Cited

U.S. PATENT DOCUMENTS

| | | | |
|---|---|---|---|
| 2,955,272 | 10/1960 | Gallardo | 439/134 |
| 4,484,692 | 11/1984 | Palermo | 220/346 |
| 4,653,824 | 3/1987 | Jason et al. | 439/134 |
| 4,782,971 | 11/1988 | Hill | 220/3.2 |
| 5,328,049 | 7/1994 | Ritzow | 220/346 |

*Primary Examiner*—Neil Abrams

*Attorney, Agent, or Firm*—Ralph Branscomb

[57] ABSTRACT

A small box with a keyed lock into which an electrical plug is placed and then locked for preventing the insertion of the electrical appliance plug into a wall socket comprises a plastic box (A) with a front sliding door (B) and a keyed cam lock (D).

2 Claims, 1 Drawing Sheet

LOCK FOR PREVENTING UNAUTHORIZED USE OF ELECTRICAL APPLIANCES

BACKGROUND-FIELD OF INVENTION

This invention relates to locks, specifically locks designed to be used with any electrical product that has an electrical chord and plug to be inserted into an electrical outlet.

BACKGROUND-DISCUSSION OF PRIOR ART

Many Americans at one time or another have struggled with the problem of preventing unwanted or unauthorized usage of electrical appliances like televisions, vcr's, stereo's and computers, especially by small children in the case of the television and home appliances like blenders, power saws and electric knives.

Heretofore prevention required building expensive cabinets with locks, lugging the electrical appliance out to the garage or into a closet with a lock.

Most owners of such appliances find these options cumbersome, laborious and often expensive.

Many people would find it desirable to have a lock that was small, inexpensive and simple to prevent usage of electrical appliances without the hassle of having to move the appliance or house it in an expensive cabinet.

OBJECTS AND ADVANTAGES

Accordingly we claim the following as our objects and advantages of the invention: to provide a lock that easily, reliably, durably and cheaply allows the blocking of an electrical device like a television from being plugged into a wall socket.

In addition we claim the following additional objects and advantages: to provide a simple alternative to physically relocating an electrical appliance to prevent its usage, security from unwanted tampering with computer files when not present, safety from accidental harm from unsupervised usage of dangerous household items like power tools and blenders and to provide an additional impediment to usage through theft.

Readers will find further objects and advantages of the invention from consideration of the ensuing description and the accompanying drawings.

SUMMARY

This invention is a lock box for receiving and locking onto the terminal plug of the power cord of an appliance, ordinarily a television set or computer, for the purpose of limiting the exposure time of children to television and mind-numbing video games. Its use is also contemplated on power tools, hot plates, lawnmowers and other electrical devices having a high propensity to injure children who may be playing in the absence of parental supervision.

The body of the box comprises a five-sided, box-like enclosure molded as a single piece of durable plastic. The plastic enclosure encloses an interior space which is accessible through a rectangular entryway opening which would have been the sixth side of the box-like enclosure. The opening is closed by a sliding door which tracks in internal tracking grooves in the sidewalls of the enclosure and passing through a clearance slot in the top wall.

The door is dimensioned to seat in the tracking grooves with the door edges substantially completely overlapped by the grooves. The trailing edge, which terminates in alignment with the exterior surface of the enclosure, likewise provides no cracks so that substantially no cracks exist around the door for prying the door in the opening direction with a knife edge.

An edge aperture defined in the leading edge of the door is just large enough to provide clearance for an electrical apparatus power cord, but not large enough to pass the plug, and an externally accessible cam lock mounted in the enclosure has means to engage the door from the inside and lock it. A nib or nibs provided on the door prevent it from accidentally escaping completely through said slot and becoming lost, so that the entire assembly is integral and self-contained except for a separate key in the event a key-operated lock is used.

BRIEF DESCRIPTIONS OF THE DRAWINGS

DETAILED DESCRIPTION OF THE PREFERRED EMBODIMENT

Figure 1:
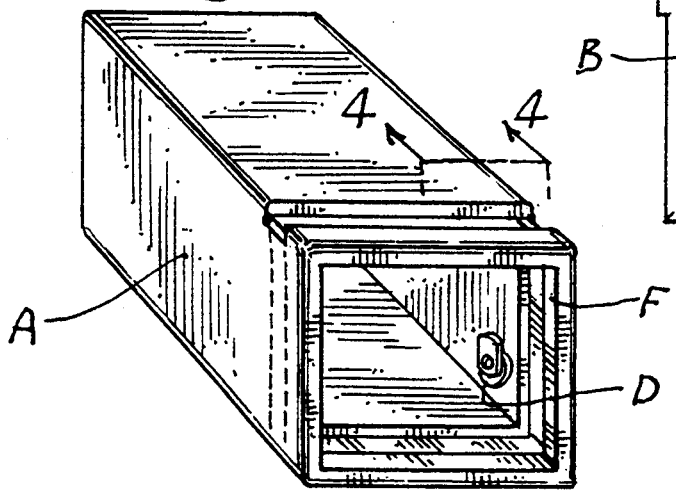
FIG. 1 is a perspective view of the open plastic box without the sliding door in place, exposing the groove in which the door slides and the cam lock which locks the door.
Figure 2:
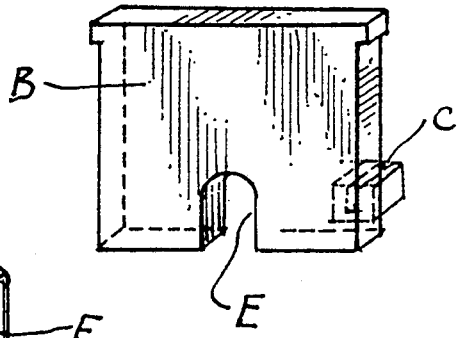
FIG. 2 is a perspective view of the sliding door for the box illustrating the slot on the door which is engaged by the arm or the cam lock with an opening in the bottom of the door for an electrical cord to enter box.
Figure 4:
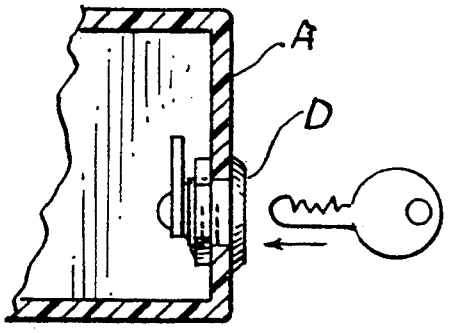
FIG. 4 is a cross section taken along line 4—4 of FIG. 1.
Figure 5:
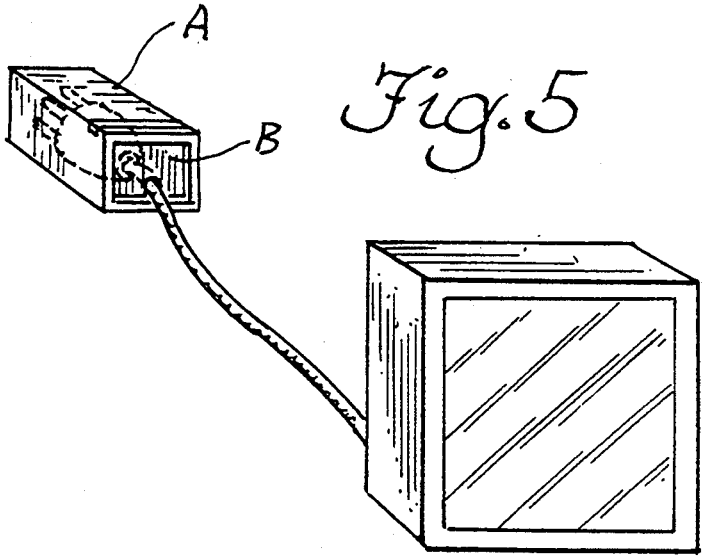
FIG. 5 is a slightly diagrammatic view of an appliance with a cord which extends through the opening in the sliding door of the lock box into the box itself where the cord plug is captured.

As shown in FIG. 1, the lock box A of the instant invention is square in cross section, being 2 inches tall, $3\frac{1}{2}$ inches long and $2\frac{1}{4}$ inches wide in the preferred embodiment. A groove F defined continuously around the interior of the box provides a track for the sliding door B to slide in and seat. Once closed, the door is locked by cam lock D, on the side of the box as best shown in FIG. 4. The lock has a tongue which swings onto the slot C defined in a projection from the rear of the door B. The door has an opening E entrant from the lower edge to pass the cord of an appliance therethrough so that the plug is inside the box as shown in FIG. 5.

The body of the box A and the door B are preferably made of high quality, durable plastic such as ABS plastic made by DuPont Chemical Company. Any available durable material can be used for the box and the door.

Although theoretically the box may be any size, it is preferably small and light-weight for convenience, yet defining enough interior space to house any common electrical two- or three-pronged plug. Wall thickness may vary, and it is desirable that all edges are radiused to reduce the risk of injury from the sharp comers and improve the esthetic appearance of the invention.

Many other variations will occur to those skilled in the art based on the forgoing description of the Preferred Embodiment, which is illustrative and not limiting.

OPERATION

Figure 3:
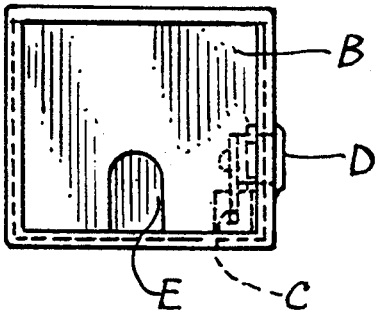
FIG. 3 is a from elevation view of the assembled box with the door in place wherein the opening for the electrical plug cord in the sliding door is visible.

The plastic box (A) shown in FIG. 1 will effectively enclose and lock around the plug to any standard electrical appliance when the plug to said appliance is placed inside said box and sliding door (B) shown in FIG. 3 is inserted into place and the keyed cam lock (D) shown in FIG. 4 is moved to the lock position by turning the key in a counter-clockwise direction lowering the lock cam into the slot protruding from the door, preventing the removal of said plug from said box and preventing the insertion of said plug into a wall socket thereby preventing the use of said appliance.

CONCLUSION, RAMIFICATIONS AND SCOPE OF INVENTION

Thus the reader will see that the lock box provides a cheap, effective, highly reliable, durable, economical, light weight and efficient device that can be used on any electrical appliance with a plug.

While my above description is geared mainly towards the usage of this device by parents to effectively control the amount of television their children watch this should not be construed as limitations on the scope of the invention, but rather as an exemplification of one preferred embodiment thereof. Many other variations are possible. For example the invention can also prohibit the unwanted access of computer files or utilization of stereos, vcr's and other entertainment equipment and also serve as a safety device to prevent small children from harming themselves with many of the dangerous products in the average household such as power tools and blenders. Accordingly, the scope of the invention should be determined not by the embodiment(s) illustrated, but by the appended claims and their legal equivalents.

We claim:

1. A lock box for receiving and locking onto the plug of a power cord of an electrical appliance, said lock box comprising:

(a) a five-sided unitary enclosure molded as a single piece of durable plastic enclosing a space accessible through a rectangular entryway opening;

(b) said enclosure defining two spaced parallel sidewalls, a top wall and a bottom wall and a rear wall;

(c) said side walls each defining an internal tracking groove adjacent said entryway with said grooves together defining a plane just inside said entryway opening, and said top wall defining a pass-through clearance slot co-planar with said grooves;

(d) a sliding door passing through said slot and tracking in said grooves and having a leading edge and a trailing edge and two side edges and being dimensioned to seat in said grooves with the respective edges thereof substantially completely overlapped by said grooves and a trailing edge thereof which terminates in alignment with the exterior surface of said enclosure, such that substantially no cracks or discontinuities are defined alongside said door for prying same in the direction in which it slides open, with a knife edge;

(e) an edge aperture defined in the leading edge of said door and being of dimension large enough to accept a power cord passed therethrough but too small to permit passage of an electrical plug therethrough;

(e) an externally accessible cam lock mounted in one of said walls and having means to engage said door internally to prevent same from opening, whereby a power cord can be entrained through said entryway with the plug disposed in said space and said door closed and locked with said edge aperture providing cord clearance, whereupon said electrical appliance is disabled.

2. Structure according to claim 1 wherein said door defines stop means to prevent its exit completely from said entryway through said clearance slot, such that said enclosure, lock and door are all interconnected and said lock box is self-contained, requiting no additional structure in order to function except for a key for said lock in the event same is a key-operated lock.

* * * * *